United States Patent [19]

Hayakawa et al.

[11] Patent Number: 5,052,731

[45] Date of Patent: Oct. 1, 1991

[54] CHILD PROTECTING MECHANISM IN DOOR LOCK APPARATUS

[75] Inventors: Shigeru Hayakawa, Chiryu; Yoshihiro Shimizu, Kariya; Ryoichi Fukumoto, Nagoya; Soichiro Okudaira, Toyota, all of Japan

[73] Assignee: Aisin Seiki Kabushiki Kaisha, Kariya, Japan

[21] Appl. No.: 497,193

[22] Filed: Mar. 22, 1990

[30] Foreign Application Priority Data

Mar. 24, 1989 [JP] Japan ..... 1-33857[U]

[51] Int. Cl.[5] ..... E05C 3/26

[52] U.S. Cl. ..... 292/336.3; 292/DIG. 27; 292/DIG. 65

[58] Field of Search ..... 292/336.3, 216, 280, 292/DIG. 65, DIG. 27

[56] References Cited

U.S. PATENT DOCUMENTS 3,923,329 12/1975 Torii et al. ..... 292/216

4,334,704 6/1982 Yamada ..... 292/216

4,382,622 5/1983 Ishikawa ..... 292/DIG. 65 X

*Primary Examiner*—Richard E. Moore

*Attorney, Agent, or Firm*—Finnegan, Henderson, Farabow, Garrett and Dunner

[57] ABSTRACT

A child protecting mechanism in a door lock apparatus includes a base internally accommodating an opening/-closing mechanism, an opening lever pivotally supported on the base for actuating the opening/closing mechanism, an inside lever and a child protecting lever pivotally supported on the base, and an opening lift lever having one end connected to the inside lever and another end connected to the child protecting lever and capable of being engaged with and disengaged from the opening lever. Turning the child protecting lever causes the opening lift lever to rock to disengage the opening lever and the opening lift lever, thereby preventing the turning motion of the inside lever from being transmitted to the opening lever.

5 Claims, 3 Drawing Sheets

CHILD PROTECTING MECHANISM IN DOOR LOCK APPARATUS

BACKGROUND OF THE INVENTION

This invention relates to a child protecting mechanism in a door lock apparatus for an automotive vehicle.

A known child protecting mechanism of this kind is as disclosed in the specification of Japanese Utility Model Application Laid Open (KOKAI) No. 55-49403. This prior-art child protecting mechanism includes a base, an opening lever for actuating an opening/closing mechanism, an inside lever connected to an inside handle, an opening lift lever for transmitting the turning motion to the opening lever to turn the opening lever, and a child protecting lever for preventing the turning motion of the inside lever from being transmitted to the opening lever, with the opening lever, opening lift lever and child protecting lever being pivotally supported on the base. The opening lift lever is capable of being engaged with the opening lever, and is capable of being engaged also with the inside lever and child protecting lever via the same slide pin. By turning the child protecting lever, the slide pin is caused to slide to disengage the inside lever and the opening lift lever, thereby placing the inside lever in a freely swinging state and establishing a locked condition.

This conventional child protecting mechanism involves certain shortcomings. Specifically, since sliding the slide pin engages and disengages the inside lever and the opening lift lever to render the turning motion of the inside lever transmittable or nontransmittable to the opening lever, namely to establish the unlocked or locked state, a change with the passage of time and the intrusion of sand and dust or the like can detract from the slidability of the slide pin. Consequently, a larger force is required to manipulate the child protecting lever, and there is the danger that the child protecting lever may become inoperable. In addition, the mechanism has a large number of component parts, assembly is difficult and costs are high.

SUMMARY OF THE INVENTION

Accordingly, an object of the present invention is to provide a door lock child protecting mechanism in which the changeover achieved by sliding a slide pin is eliminated.

According to the present invention, the foregoing object is attained by providing a child protecting mechanism in a door lock apparatus, comprising a base internally accommodating an opening/closing mechanism, an opening lever pivotally supported on the base for actuating the opening/closing mechanism, an inside lever pivotally supported on the base, a child protecting lever pivotally supported on the base, and an opening lift lever having one end connected to the inside lever and another end connected to the child protecting lever and capable of being engaged with and disengaged from the opening lever.

In operation, turning the child protecting lever causes the opening lift lever to rock to disengage the opening lever and the opening lift lever, thereby preventing the turning motion of the inside lever from being transmitted to the opening lever. Thus, owing to the rocking action of the opening lift lever, the opening lever and the opening lift lever are engaged and disengaged to establish the unlocked or locked state. As a result, the portions for changing over between the engaged and disengaged state undergo little change with time, there is no longer an increase in the force necessary to manipulate the child protecting lever and there is no danger of the child protecting lever becoming inoperable. In addition, dispensing with the slide pin makes it possible to simplify the apparatus and lower cost.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An embodiment of the present invention will now be described in detail with reference to the accompanying drawings.

Figure 1:
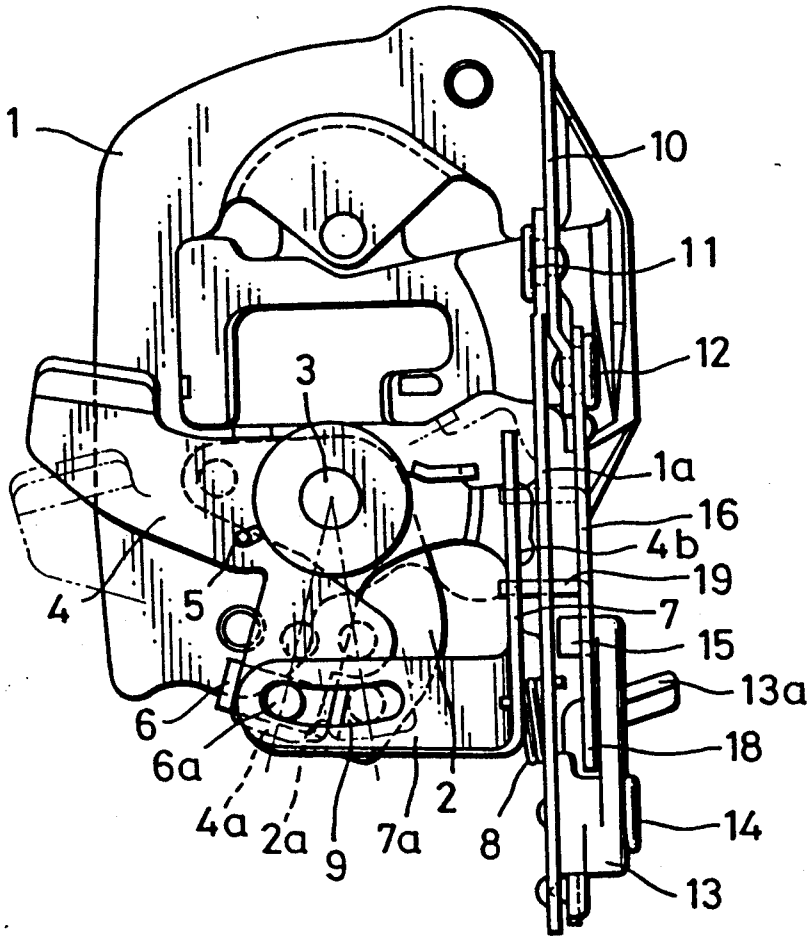
FIG. 1 is a plan view showing a door lock apparatus according to the present invention.

As shown in FIG. 1 illustrating a child protecting mechanism in door lock apparatus for an automotive vehicle, a lift lever 2 for actuating an opening/closing mechanism (not shown) is pivotally supported by a pivot pin 3 on a base internally accommodating the opening/closing mechanism, which comprises a pawl and a latch. An opening lever 4 is pivotally supported on the pivot shaft 3 and is urged clockwise in FIG. 1 at all times by a spring 5. A slide member 6 having a pin **6*a* erected thereon is slidably retained on one end 4*a* of the opening lever 4. The pin 6*a* is capable of being engaged with one end 2*a* of the lift lever 2. A locking lever 7 connected to a locking knob (not shown) is pivotally supported by a spring 8 on an upstanding portion 1*a* of the base 1 so as to capable of turning to a limited extent. One end 7*a* of the locking lever 7 is formed to include an oblong hole 9 defining a circular arc whose center is the pivot pin 3. The pin 6*a* is mated with the oblong hole 6*a***.

Figure 2:
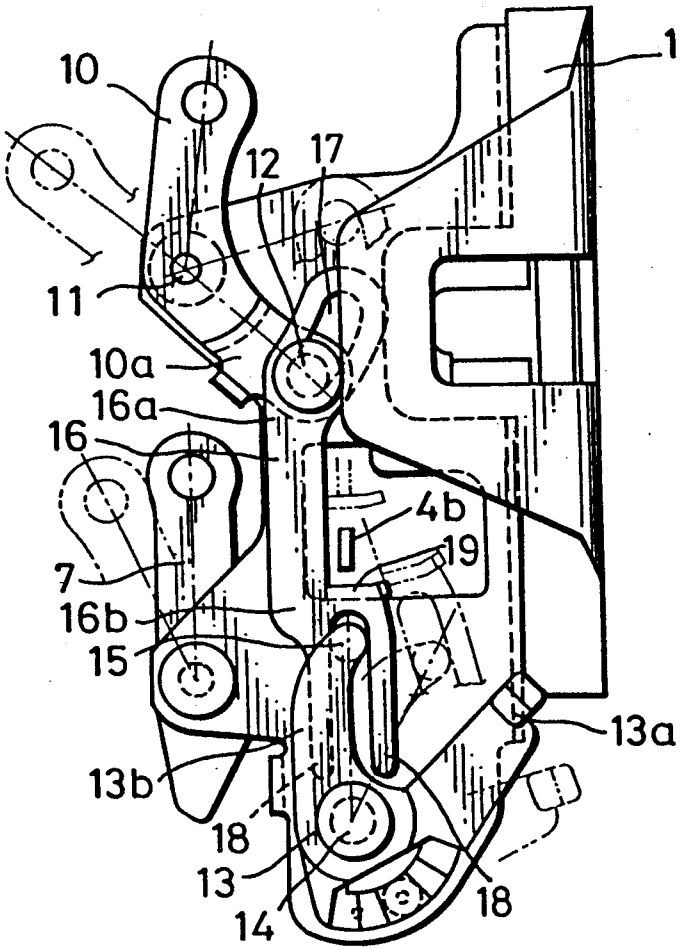
FIG. 2 is a side view of the apparatus shown in FIG. 1.

As shown in FIGS. 1 and 2, an inside lever 10 connected to an inside handle (not shown) is pivotally supported by a pivot pin 11 on the upstanding portion **1*a* on the upper side of the vehicle (the upper side in FIG. 2). A pin 12 is implanted in one end 10*a* of the inside lever 10. A child protecting lever 13 formed to have a handle portion 13*a* is pivotally supported by a pivot pin 14 on the upstanding portion 1*a* on the lower side of the vehicle (the lower side in FIG. 2). One end portion 13*b* of the child protecting lever 13 is formed to have a pin 15. An opening lift lever 16 is disposed between the inside lever 10 and the child protecting lever 13. One end 16*a* of the opening lift lever 16 is formed to have an oblong hole 17 defining a circular arc whose center is the pivot pin 11. The pin 12 is mated with the oblong hole 17. The latter is utilized for initial play when the inside lever 10** is manipulated. In a case where it is unnecessary to set play, the oblong hole 17 may be dispensed with and the pin 12 may be connected directly to the opening lift lever 16. Further, another end 16*b* of the opening lift lever 16 is formed to have a bifurcated portion 18 with which the pin 15 is engaged. The opening lift lever 16 is formed to have an engaging portion 19 capable of engaging with the other end 4*b* of the opening lever 4. It is possible to adopt an arrangement in which the bifurcated portion 18 is replaced by an oblong hole.

The operation of the apparatus will now be described.

Figure 4:
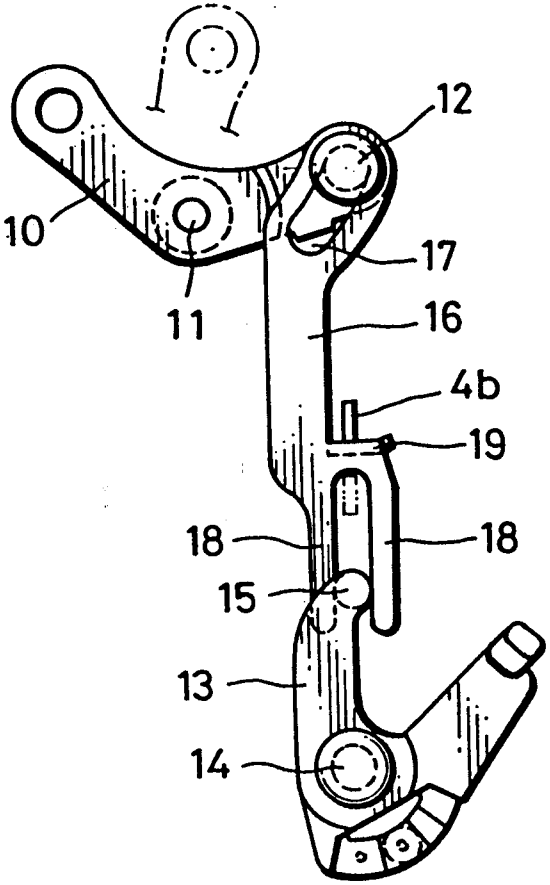
FIG. 4 is a plan view showing an inside lever in FIG. 3 after the lever has been turned.
Figure 3:
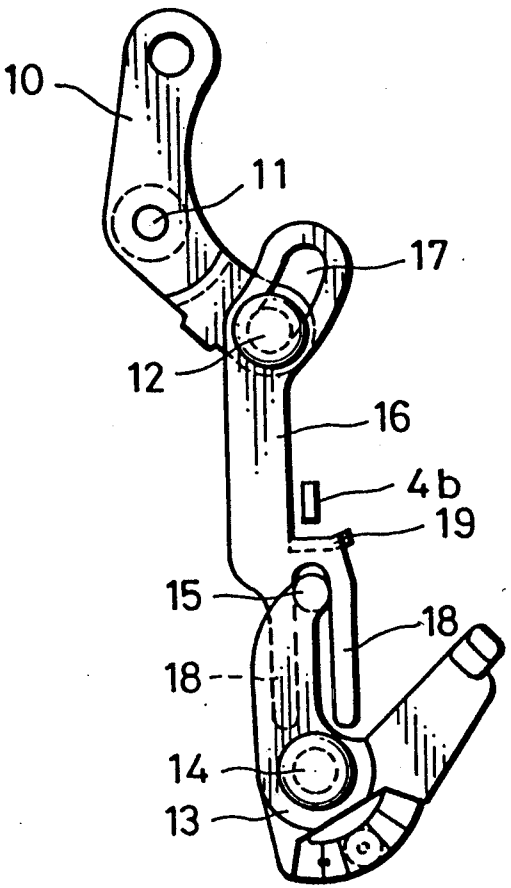
FIG. 3 is a plan view showing a child protecting mechanism in an unlocked state.
Figure 6:
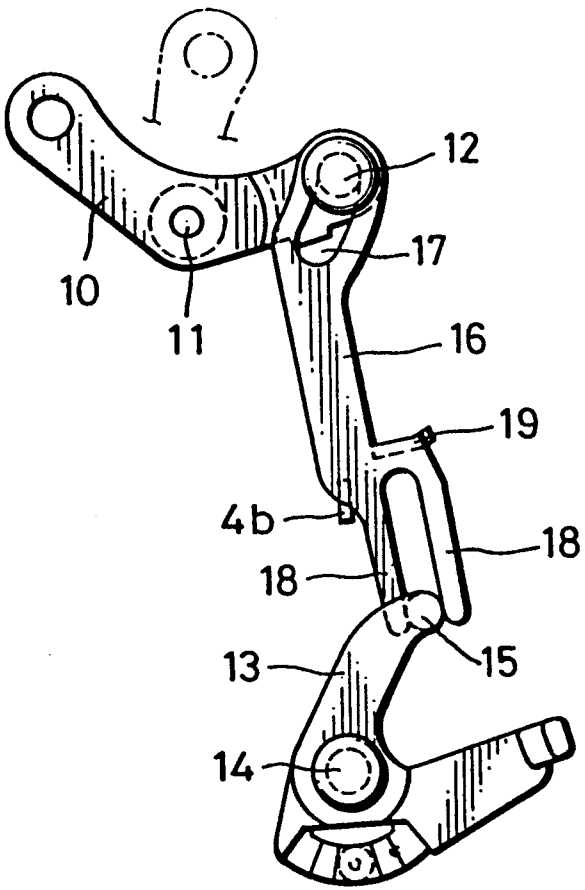
FIG. 6 is a plan view an inside lever in FIG. 5 after the lever has been turned.

When, in the state shown in FIG. 1, the inside handle is manipulated to turn the inside lever 10 counter-clockwise in FIG. 2, the opening lift lever 16 is shifted from the position indicated by the solid line in FIG. 2 to the position indicated by the two-dot chain line in FIG. 2 (i.e., a transition is made from the state of FIG. 3 to the state of FIG. 4). Owing to this movement of the opening lift lever 16, the engaging portion 19 and the other end 4*b* of the opening lever 4 engage and the opening lever 4 turns counter-clockwise in FIG. 1 against the biasing force of the spring 5. Owing to the turning motion of the opening lever 4, the pin 6*a* of the slide member 6 and the end 2*a* of the lift lever 2 engage, thereby turning the lift lever 2 to actuate the opening/closing mechanism. As a result, the vehicle door (not shown) opens. Further, when the locking knob is actuated in the state of FIG. 1 to turn the locking lever 7 clockwise in FIG. 1, the slide member 6 is shifted from the position indicated by the solid line in FIG. 1 to the position indicated by the two-dot chain line in FIG. 1 due to engagement between the oblong hole 9 of the locking lever 7 and the pin 6*a* of the slide member 6. Owing to sliding of the slide member 6, the pin 6*a* of the slide member 6 and the end 2*a* of the lift lever 2 are no longer in an engageable state, or in other words, the locked state is attained in which the turning motion of the opening lever 4 is prevented from being transmitted to the lift lever 2. As a result, the door will not open even if the inside handle is manipulated.

Figure 5:
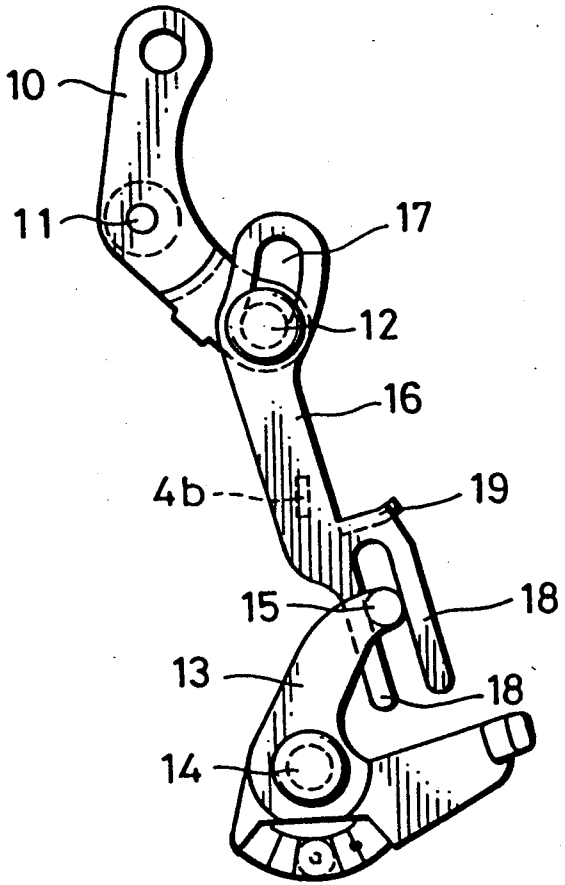
FIG. 5 is a plan view showing the child protecting mechanism in the locked state.

Furthermore, when the handle 13*a* is manipulated in the state of FIG. 1 to turn the child protecting handle 13 clockwise in FIG. 2, the opening lift lever 16 is rocked about the pin 15 from the position of the solid line in FIG. 2 to the position of the two-dot chain line in FIG. 2 (i.e., a transition is made from the state of FIG. 3 to the state of FIG. 5). Owing to this rocking motion, the engaging portion 19 of the opening lift lever 16 and the other end 4*b* of the opening lever 4 are no longer in an engageable state, or in other words, the locked state is attained in which the turning motion of the opening lift lever 16 is prevented from being transmitted to the opening lever 4. As a result, even if the inside lever 10 is turned, it performs no meaningful action and the door will not open, irrespective of the state of the locking lever 7.

Thus, by rocking the opening lift lever 16, the engaging portion 19 of the opening lift lever 16 and the end 4*a* of the opening lever 4 are engaged or disengaged, whereby the locked or unlocked state is attained. Consequently, the portions for changing over between the engaged and disengaged state undergo little change with time, there is no longer an increase in the force necessary to manipulate the child protecting lever 13 and there is no danger of the child protecting lever 13 becoming inoperable. In addition, dispensing with the conventional slide pin makes it possible to simplify the apparatus and lower cost owing to a reduction in the number of component parts. Furthermore, whereas the inside handle and opening lift lever are engaged and disengaged by the sliding of the slide pin owing to manipulation of the child protecting lever in the prior-art apparatus, in the present invention the opening lift lever 16 and the opening lever 9 are engaged and disengaged. As a result, the inside lever 10, opening lift lever 18 and child protecting lever 13, which had to be disposed close to the lower side of the vehicle (the lower side in FIG. 2) in the prior, can be disposed in space-apart relation in the present invention, and therefore the locking lever 7 can be disposed on the lower side of the vehicle (the lower side in FIG. 2). As a result, the opening lever 4 and the locking lever 7 can be functionally connected together directly without the intermediary of a locking rod. This makes it possible to simplify the apparatus and lower its cost by reducing the number of component parts.

The child protecting mechanism in the door lock apparatus of the present invention is advantageous in that the portions for changing over between the engaged and disengaged state undergo little change with time, there is no longer an increase in the force necessary to manipulate the child protecting lever, and there is no danger of the child protecting lever becoming inoperable. In addition, dispensing with the conventional slide pin makes it possible to simplify the apparatus and lower cost. Moreover, the inside lever, opening lift lever and child protecting lever, which had to be disposed close to the lower side of the vehicle in the prior, can be disposed in space-apart relation in the present invention, and therefore the locking lever can be disposed on the lower side of the vehicle (the lower side in FIG. 2). As a result, the opening lever and the locking lever can be functionally connected together directly without the intermediary of a locking rod. This makes it possible to simplify the apparatus and lower its cost by reducing the number of component parts.

As many apparently widely different embodiments of the present invention can be made without departing from the spirit and scope thereof, it is to be understood that the invention is not limited to the specific embodiments thereof except as defined in the appended claims.

What is claimed is:

1. A child protecting mechanism in a door lock apparatus, comprising:

a base internally accommodating a door opening/closing mechanism;

a locking lever for connection to a locking knob;

an opening lever pivotally supported on said base for actuating said opening/closing mechanism, said opening lever having a slide portion engageable with the locking lever for rendering the opening lever ineffective to actuate said opening/closing mechanism;

an inside lever pivotally supported on said base;

a child protecting lever pivotally supported on said base; and an opening lift lever having one end connected to said inside lever and another end connected to said child protecting lever, said opening lift lever being capable of engaging and disengaging said opening lever, said child protecting lever when pivoted being operative to pivot said opening lift lever out of engagement with said opening lever for rendering the opening lift lever ineffective to actuate said opening/closing mechanism.

2. A child protecting mechanism according to claim 1, wherein said opening lift lever has at one end a hole receiving a pin on said inside lever, said opening lift lever having at the other end a bifurcated portion receiving a part of said child protecting lever.

3. A child protecting mechanism according to claim 1, wherein said base has an upstanding wall, and the opening lift lever is disposed along said wall.

4. A child protecting mechanism in a door lock apparatus, comprising;

a base internally accommodating a door opening/-closing mechanism;

an opening lever pivotally supported on said base for actuating said opening/closing mechanism;

an inside lever pivotally supported on said base said inside lever having a pin extending therefrom;

a child protecting lever pivotally supported on said base; and an opening lift lever having at one end an oblong hole receiving the pin of said inside lever and at another end a bifurcated portion for receiving a part of said child protecting lever; said opening lift lever being capable of engaging and disengaging said opening lever, said child protecting lever when pivoted being effective to pivot said opening lift for disengaging said opening lever.

5. A child protecting mechanism according to claim 4, wherein said base has an upstanding wall, and the opening lift lever is disposed along said wall.

* * * * *